United States Patent [19]

Iwao

[11] 4,236,346

[45] Dec. 2, 1980

[54] TOY HAVING A SEEMINGLY RANDOM MOVEMENT

[75] Inventor: Noriaki Iwao, Tokyo, Japan

[73] Assignee: Tomy Kogyo Co., Inc., Tokyo, Japan

[21] Appl. No.: 17,413

[22] Filed: Mar. 5, 1979

[30] Foreign Application Priority Data

Aug. 25, 1978 [JP] Japan ..... 53-116336[U]

[51] Int. Cl.[3] ..... A63H 11/10

[52] U.S. Cl. ..... 46/104; 46/123; 46/206

[58] Field of Search ..... 46/97, 98, 103, 104, 46/105, 123, 152, 163, 164, 202, 206, 106, 107

[56] References Cited

U.S. PATENT DOCUMENTS

| | | | |
|---|---|---|---|
| 699,780 | 5/1902 | Woerner | 46/163 |
| 2,306,898 | 12/1942 | Palmer | 46/103 |
| 2,425,051 | 8/1947 | Steinitz | 46/123 |
| 2,607,163 | 8/1952 | Lohr | 46/206 |
| 2,629,967 | 3/1953 | Lohr et al. | 46/104 |
| 3,060,630 | 10/1962 | Collischan | 46/98 |
| 3,462,880 | 8/1969 | Tomaro, Jr. | 46/247 |
| 3,894,353 | 7/1975 | Oguchi | 46/145 |
| 4,087,935 | 5/1978 | Edmisson et al. | 46/206 |

*Primary Examiner*—David L. Lacey

*Attorney, Agent, or Firm*—K. H. Boswell; Edward D. O'Brian

[57] ABSTRACT

A mechanical toy which has a seemingly random movement of both its extendable parts and its motion is described. The toy has a base to which is attached several extendable members which can be pushed into the toy by the child to a retractable position. The extendable members are held in the retractable position by a series of independently acting holding members. The toy includes a button which is positioned so that a child may easily push it. On depression of the button one, several or all of the extendable members may be released from the retracted position allowing them to extend out of the toy into an extended position. Concurrently the propulsion mechanism of the toy may or may not also be activated causing the toy to move along the surface on which it is set. The propulsion mechanism is energized by the child mechanically depressing one of the extensions into its retracted position.

12 Claims, 12 Drawing Figures

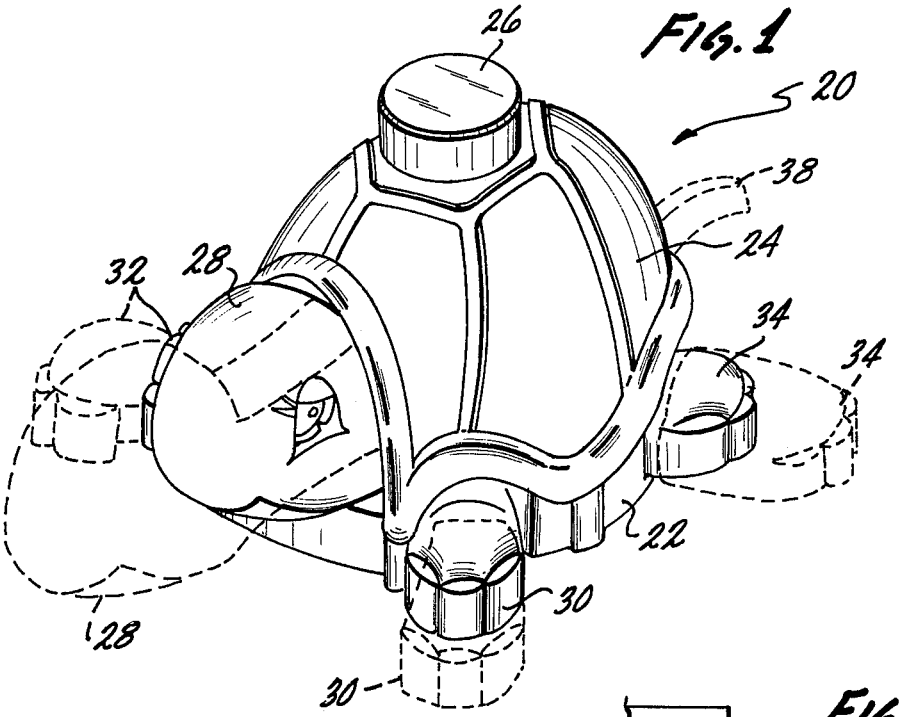
FIG. 1
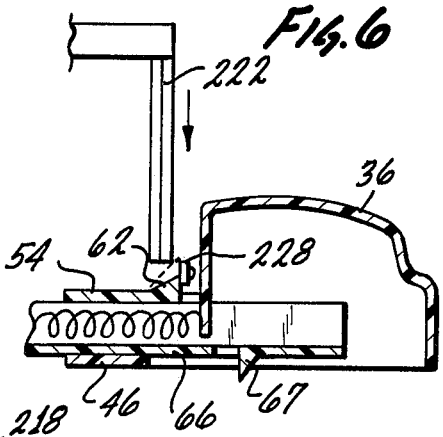
FIG. 6
FIG. 8
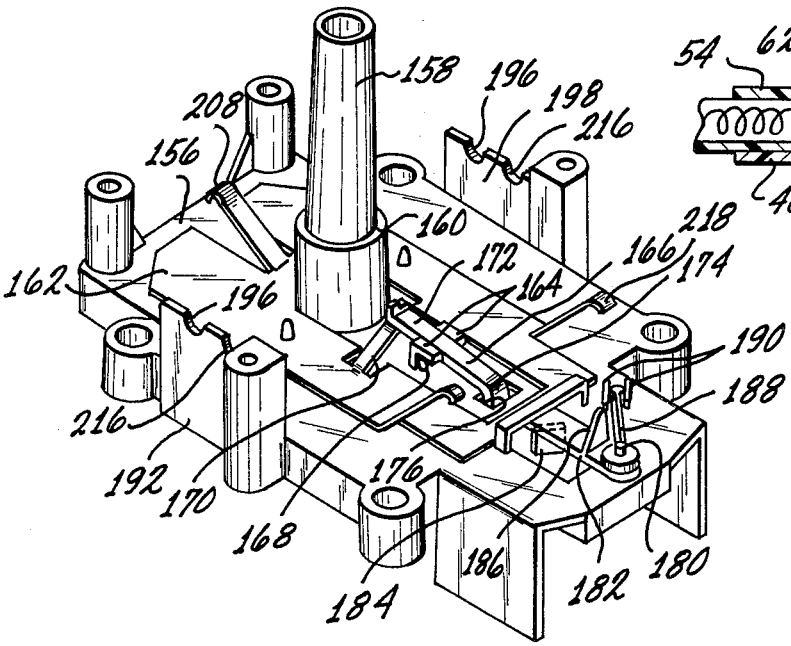

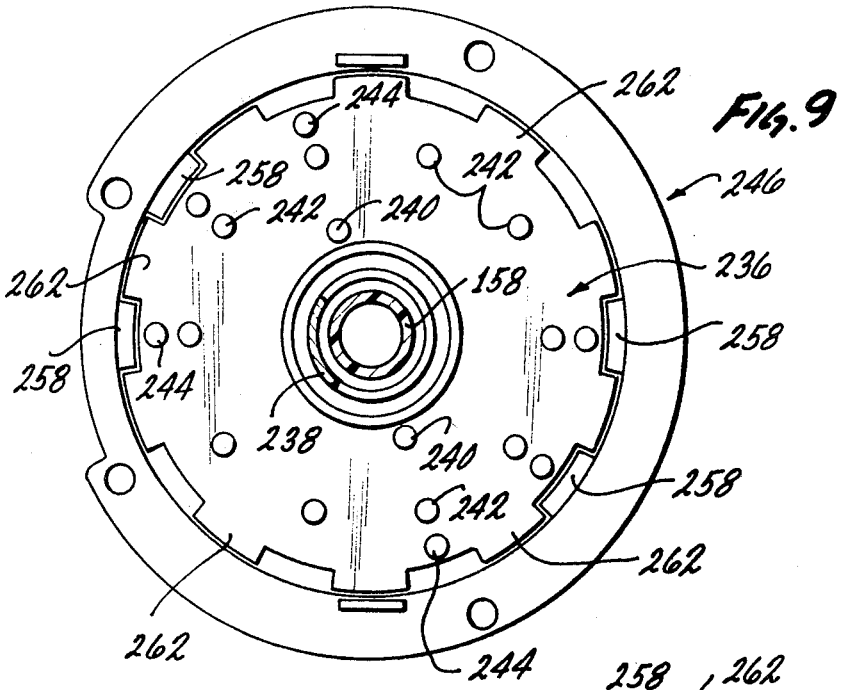
Fig. 9
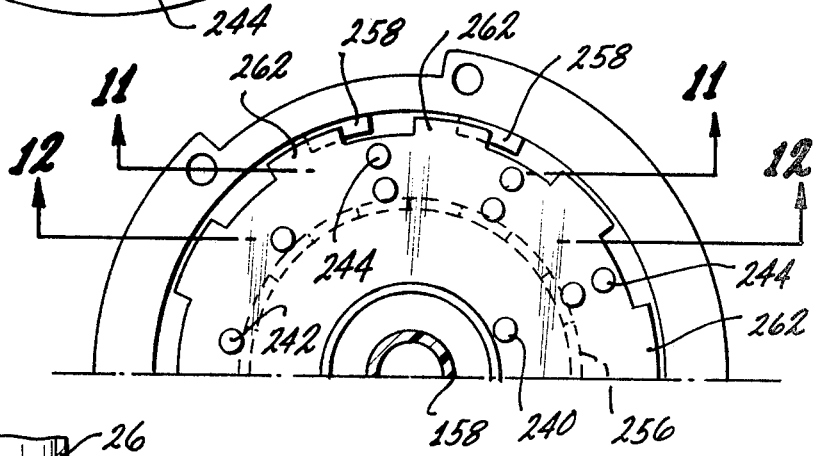
Fig. 10
Fig. 12
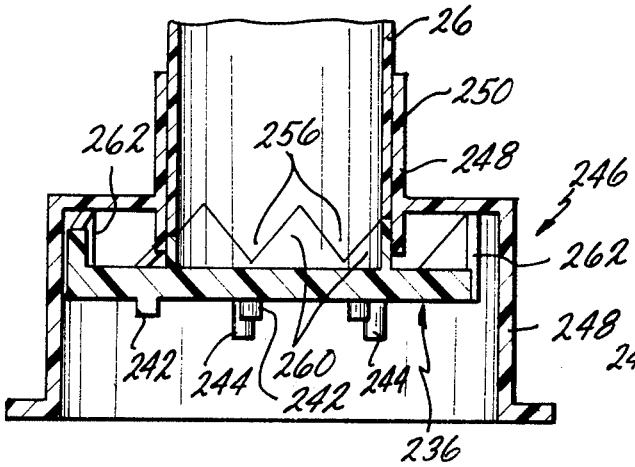
Fig. 11
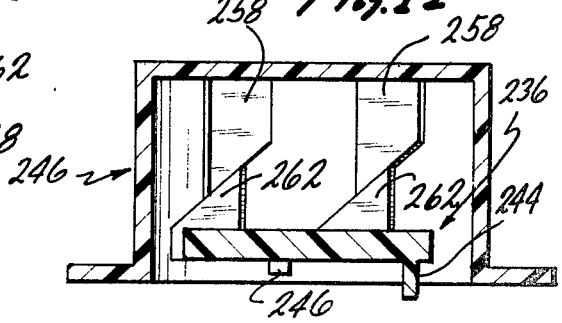

TOY HAVING A SEEMINGLY RANDOM MOVEMENT

BACKGROUND OF THE INVENTION

This invention is directed to a mechanical toy having a plurality of members which have an extended and a retracted position. Upon depression of an activation button the members in a seemingly random way are allowed to go from the retracted to the extended position and additionally a propulsion mechanism is also seemingly randomly activated.

There are many push toys available for children's use. Included in this group of push toys are toys which also have appendages or other parts which will move as the toy is pushed or otherwise played with. Generally, these toys are directed to children at or near the toddler age and as such, many of the toys are manufactured to represent animals or the like which are interesting to this age group of children. During this period of development of the child, the child is learning many things about the world around him and is interested in exploring and figuring out the why and how of his world. While the above described push toys are interesting and useful in play for the child it is considered that toys which also give the child the chance to start developing his reasoning capacities are also of value.

Along with occupying a child's mind, toys also are useful which help develop a child's coordination. Thus, at what could be described as the toddler stage, toys which require the child to physically manipulate certain parts also are useful in helping the child learn to manipulate his own body.

In view of the above it is considered that there is a need for toys which entertain the child, help educate the child and help the child to develop the necessary physical coordination needed later in life.

BRIEF SUMMARY OF THE INVENTION

It is an object of this invention to provide a toy directed to the toddler age which is capable of simply being used as a push toy for the very young child but as the child in this age group is rapidly developing, it is a further object that this toy also will be capable of teaching the child hand and eye coordination. It is a further object to provide a toy that stimulates the child's imagination by allowing him to discover what will happen upon activating a toy which has a seemingly random pattern of action to the child.

Additionally, because toys that are directed to the toddler age group must sometimes stand up to physical abuse while at the same time being safe for use by such a small child, it is a further object to provide a strong yet safe toy that is economically manufactured, and thus available to many children.

In accordance with the above objects and other objects and advantages which will become apparent from the remainder of this specification, there is provided a toy which comprises a base having a plurality of movable extensions independently movably mounted on the base, such that each of the extensions can move between a retracted position and an extended position, and further, associated with each of the movable extensions is a holding member which is capable of holding the particular extension with which it is associated in the retracted position, and associated with the holding members is a releasing mechanism mounted on the base which has a plurality of operational modes wherein in each of these individual operational modes the release mechanism releases one or more of the holding members which allows the individual extensions associated with the holding members which are so released to move from the retracted position to the extended position.

Additionally, associated with one of the extendable members is an energizing mechanism which, when the particular member is moved from its extended position to its retracted position energizes the energizing mechanism and this energizing mechanism also has a holding member which, in addition to the random release of the other extending members, also can be seemingly randomly released such that upon its release, the toy is propelled across the surface on which it rests.

Normally the toy will be formed in the shape of an animal and the extendable members will be so constructed as to imitate the limbs and other appendages of the animal. The energizing mechanism generally will be associated with the head of the animal which distinguishes it from any bilateral parts such as arms or legs. In use, the child depresses the head and other limbs into the animal's body and they are retained therein by the holding members. A large button is incorporated into the body of the animal and when this button is depressed the internal mechanism of the toy will, in what seems a random fashion to the child, cause one or more of the limbs and/or the head of the animal to be extended from the body, and further sometimes activates the propulsion mechanism causing the animal to move.

BRIEF DESCRIPTION OF THE DRAWINGS

This toy will be best understood when taken in conjunction with the attached drawings wherein:

FIG. 1 shows an isometric view of the embodiment of the toy wherein certain of the extendable parts are shown in solid lines in their retracted position and in phantom lines in their extended position;

FIG. 6 is a side elevational view of a portion of FIG. 2 taken at the line 6—6 of FIG. 2;

FIG. 8 is an isometric view of certain internal components of the toy which would generally lay directly underneath the component shown in FIG. 7;

FIG. 9 is a bottom elevational view of a portion of the toy taken at the line 9—9 of FIG. 3;

FIG. 10 shows a portion of the component as viewed in FIG. 9 except certain of these components are shown in a different position with respect to the other components;

FIG. 11 is a side elevational view of a portion of the component shown in FIG. 10 taken at the line 11—11 of FIG. 10; and FIG. 12 is a side elevational view of a portion of the component shown in FIG. 10 taken at the line 12—12 of FIG. 10.

DETAILED DESCRIPTION

Figure 2:
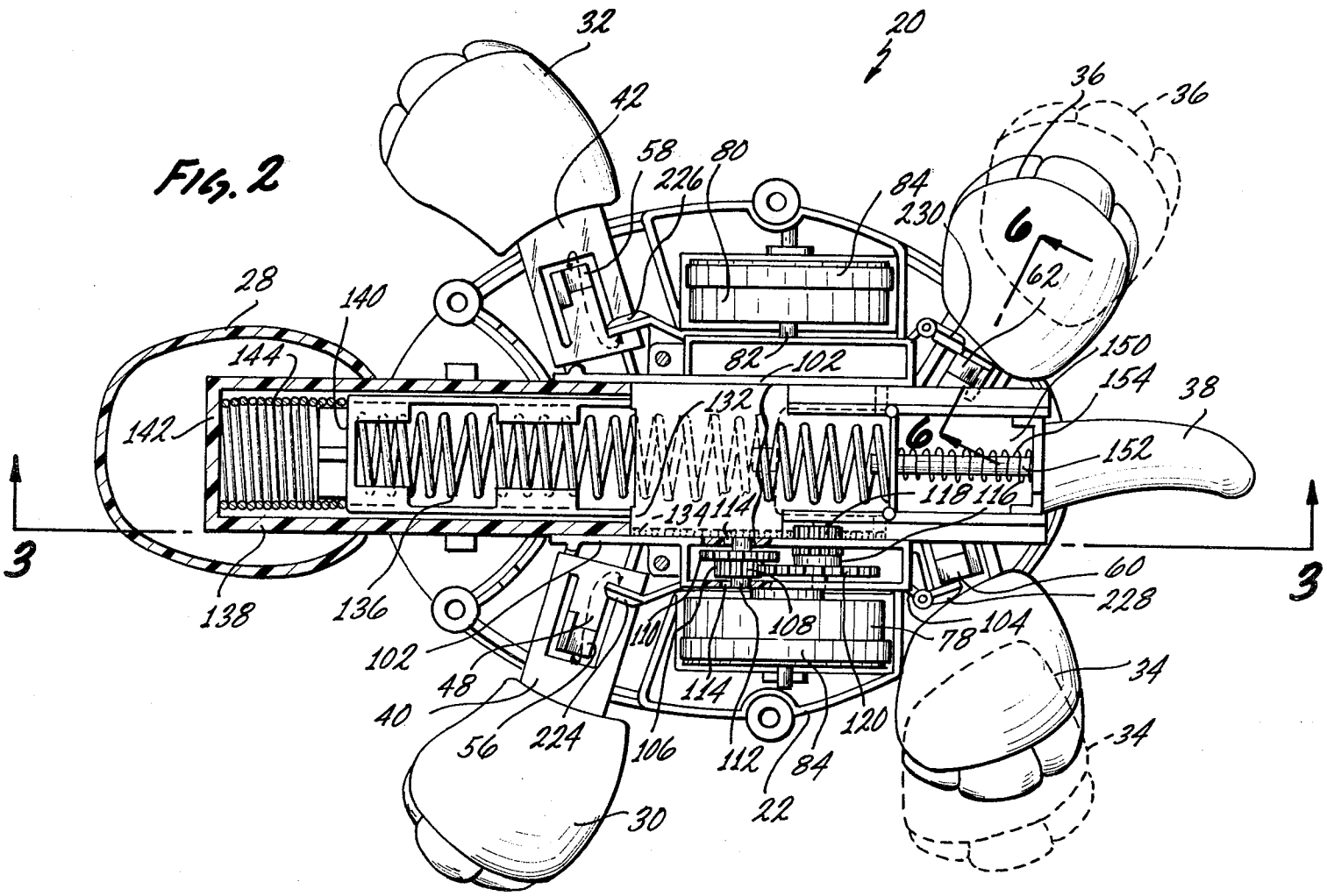
FIG. 2 is a top plan view of the invention shown in FIG. 1 with certain of the parts shown in section.

In FIG. 1 the outside appearance of the presently preferred embodiment of the toy 20 is shown. The toy 20 has a base 22 having a top 24 which fits thereon and centered in the top 24 is an activating button 26. A movable extension has a head 28 attached on its end. The head 28 is shown in FIG. 1 in a retracted position. A right front foot 30 and a left front foot 32 project out of the front of the toy 20 and analogously a right rear foot 34 and a left rear foot 36 project out of the rear of the toy 20. Additionally, a tail 38 is also attached to the body. The right front and rear feet 32 and 34 are shown in a retracted position in solid line and the right and left front feet 30 and 32 and the right rear foot 34 as well as the tail 38 and head 28 are shown in their extended position in phantom in FIG. 1.

All of the movable appendages, that is the head 28, the feet 30, 32, 34 and 36 and the tail 38, are capable of being manually pushed from their extended position into their retracted position and are held in the retracted position by internal components as hereinafter described. After pushing the above noted appendages into the retracted position the child playing with the toy pushes on the button 26, and as will be hereinafter described one of a plurality of, or all of, the appendages are freed from their retracted position and assume their extended position. Additionally when the child pushes the button 26 the toy may or may not be propelled along the surface on which it is supported. The action of releasing the appendages or propelling the toy is governed in what, to the child would seem like a random fashion. However, the particular sequence of releasing the appendages and/or propulsion of the toy is in fact governed by certain internal components as hereinafter described.

Figure 4:
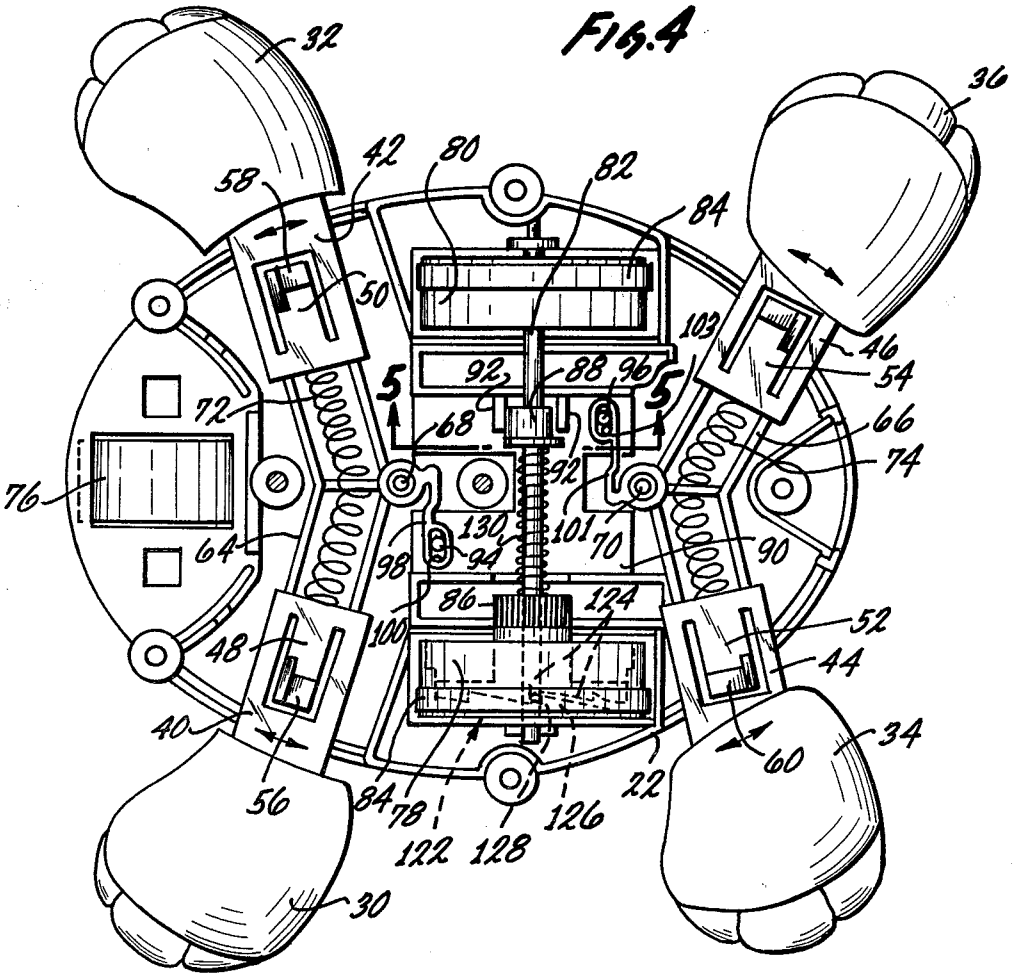
FIG. 4 is a top plan view similar to FIG. 2 except that many of the overlying components have been removed to expose the bottom-most components of the toy.

Referring now to FIG. 4, the lowermost internal working components of the toy 20 are shown. Projecting out of the base 22 are the feet 30, 32, 34 and 36 as hereintofore described. All of these feet 30, 32, 34 and 36 are integrally formed with a bracketed member 40, 42, 44 and 46 respectively. Each of these bracketed members have a similar function, except that depending on the placement, i.e., left, right, front or rear, their symmetery is slightly different. Each of the bracketed membrs 40, 42, 44 and 46 contains an integrally formed projections 48, 50, 52 and 54, respectively, which have detent teeth 56, 58, 60 and 62 respectively integrally formed thereon. Since the bracketed members 40, 42, 44 and 46, and also the projections 48, 50, 52, and 54, are preferredly formed of a plastic material, the projections 48, 50, 52 and 54 serve as springs allowing the detent teeth 56, 58, 60 and 62 to rise and fall with respect to the bracketed members 40, 42, 44 and 46.

Two identically shaped support members, front support member 64 and rear support member 66, fit over two upstanding axles 68 and 70 which project from the surface of the base 22. The bracketed members 40, 42, 44 and 46 slide over the support members 64 and 66 and are each retained thereon by a small detent tooth 67 (illustrated only for one foot 36 in FIG. 6 , but found also on feet 30, 32 and 34) on the bottom of the support members 64 and 66. Two identical springs, front spring 72 and rear spring 74, fit within support members 64 and 66, respectively, and bias the bracketed members 40, 42, 44 and 46 and their associated feet, 30, 32, 34 and 36, away from the center of the base 22.

A front wheel 76 appropriately suspended by an axle 77 is rotatably mounted in the base 22. Two rear wheels 78 and 80 are fixeldy mounted about axle 82 which fits into appropriate bearing surfaces (not numbered) in base 22. The front and rear wheels 78 and 80 both have a rubber tread 84 on their surface which provides gripping power for these wheels with the support surface on which the toy is placed. The toy is suspended from a support surface by the triangular wheel arrangement provided by wheels 76, 80 and 84.

Figure 5:
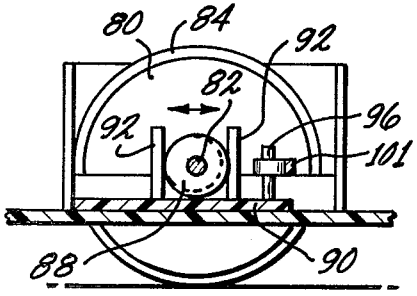
FIG. 5 is a side elevational view of that portion of FIG. 4 taken at the line 5—5 of FIG. 4.

Mounted on axle 82 near wheel 78 is a pinion 86 which is free-wheeling about axle 82. Fixedly mounted on axle 82 slightly off center toward wheel 80 is a cam 88. As shown in FIG. 5 this cam is off center from the center of the axle 82 and as axle 82 spins, the cam spins eccentrically. Slidably mounted on the surface of base 22 is a sliding member 90. Sliding member 90 has two vertical projections collectively identified by the numeral 92 which project from the surface of sliding member 90. Cam 88 fits within these two vertical projections 92 and as axle 82 spins the rotation of cam 88 within the vertical projections 92 causes sliding member 90 to oscillate back and forth on the surface of base 22. Also projecting in a vertical direction from sliding member 90 is a front peg 94 and a rear peg 96. These pegs are caused to move by the movement of sliding member 90.

Attached to front support member 64 is an arm 98 having an elongated groove 100 in its surface. Groove 100 fits over peg 94 and as sliding member 90 slides back and forth, this motion is transferred to arm 98 by the interaction of peg 94 in groove 100. This causes front support member 64 to pivot about axle 68 ultimately causing feet 30 and 32 to move in a forward and backward motion. Likewise, rear support 66 has an arm 101 having a groove 103 which fits on peg 96 which transfers the motion of sliding members 90 to back and forth motion of rear feet 34 and 36.

A housing 102 mounts over the base 22 in essentially the center of the toy. Attached to this housing 102 is a compartment 104. Mounted within the compartment 104 is a gear 106 having a set of pinion teeth 108 and a set of spur teeth 110. An axle 112 is integrally formed as part of the gear 106. In the opposite walls of compartment 104 are two identical grooves 114 which lie at an oblique angle to both the horizontal and vertical axis. The gear 106 is mounted by its axle 112 within the grooves 114 and as such the gear 106 has a degree of play within compartment 104. Fixedly mounted within compartment 104 is a second gear 116 which has a set of pinion teeth 118 and a set of spur teeth 120. The spur teeth 120 of gear 116 mate with and are in continuous contact with the pinion teeth 108 throughout the limited travel of gear 106 within groove 114. The spur teeth 110 of gear 106 mate with the pinion 86 when gear 106 is in its lowermost limited travel within grooves 114. When gear 106 slides in an upward direction in grooves 114 the spur teeth 110 disengage the pinion 86 and any motion of either gear 106 or pinion 86 is not transferred from one to the other.

Integrally formed with pinion 86 is a slip clutch member 122 having a series of obliquely formed detent teeth collectively identified by the numeral 124 integrally formed thereon. Within the interior of wheel 78 is a matching slip clutch member 126 having matching detent teeth 128 formed thereon. Pinion 86 and slip clutch member 122 are free-wheeling about axle 82 and are biased toward slip clutch member 126 by spring 130 which fits around axle 82 between slip clutch member 126 and cam 88. The function of this clutch mechanism will be described below.

A sliding member 132 has a rack of gear teeth 134 on a portion thereof. The sliding member 132 fits within housing 102 such that the rack of gear teeth 134 mates with and interacts with pinion teeth 118 on gear 116. A compression spring 136 fits within sliding member 132 and abuts against the rear of housing 102. This biases sliding member 132 in a forward direction in respect to housing 102.

A major extension member 138, having head 28 on its end fits over one end of sliding member 132. Interposed between the end of sliding member 132 and an interior wall 142 of major extension member 138 is a compression spring 144.

Compression spring 144 is of slightly less compression strength than compression spring 136. If the major extension member 138 and head 28 attached to it are pushed from an extended position into the interior of the toy 20 to a retracted position, first compression spring 144 is compressed until the end 146 of major extension member 138 contacts a shoulder 148 on sliding member 132. Further movement of major extension member 138 is transferred via end 146 abutting against shoulder 148 to sliding member 132. As sliding member 132 slides within compartment 104 compression spring 136 is compressed.

Figure 3:
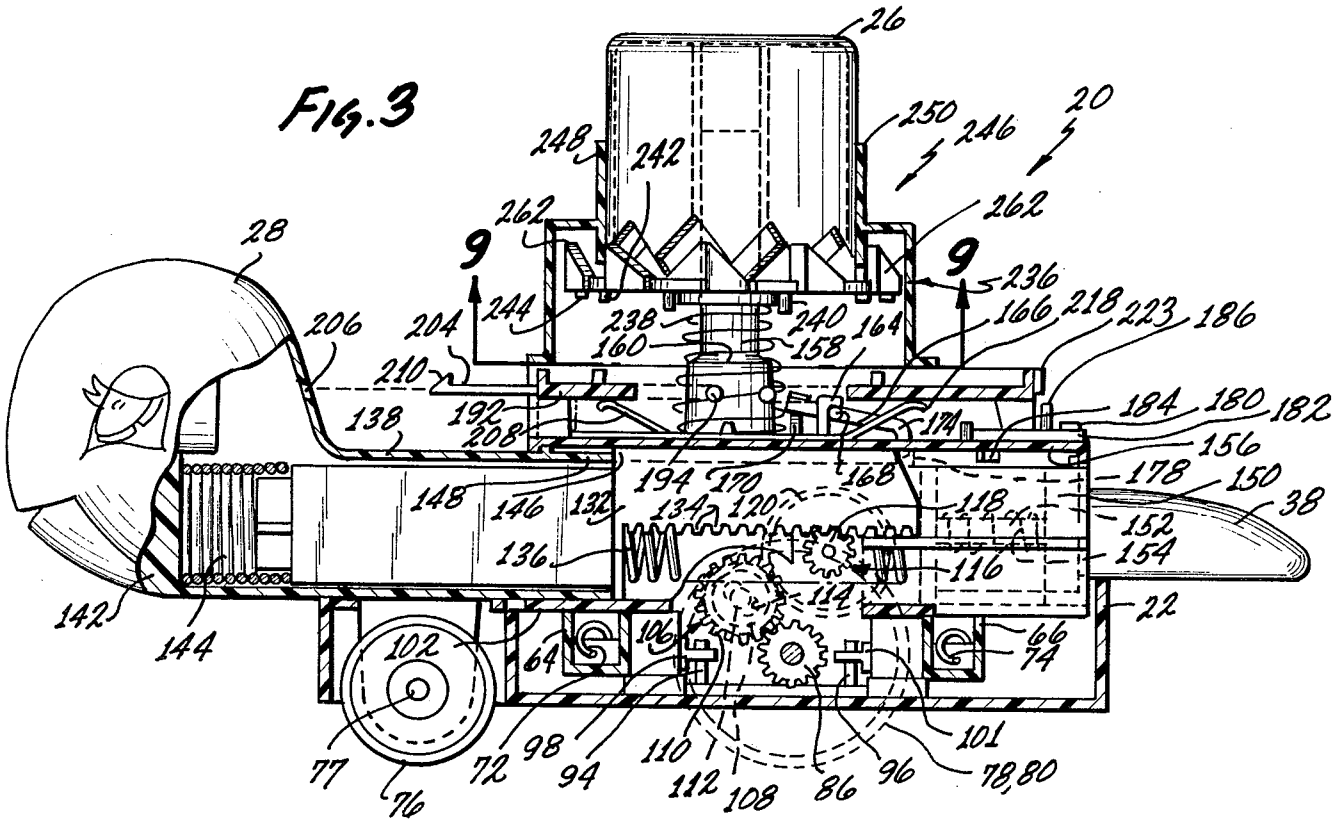
FIG. 3 is a side elevational view in partial section taken at the line 3—3 of FIG. 2.

As sliding member 132 moves in a rearward direction within housing member 102 gear rack 134 interacts with and spins gear 116. As shown in FIG. 3 this causes gear 116 to move in a clockwise direction. The clockwise spin of gear 116 is transferred to gear 106 causing it to spin counterclockwise; however, this clockwise spin of gear 116 also lifts gear 106 within grooves 114 causing gear 106 to lift free of pinion 86. Conversely, when the force of the compression spring 136 is allowed to push sliding member 132 in a forward direction in housing 102 as hereinafter described, gear rack 134 causes gear 116 to spin counterclockwise which in turn causes gear 106 to spin clockwise. This forces gear 106 downward within grooves 114 causing gear 106 to mate with pinion 86 transferring motion to axle 82 via the interaction of the slip clutch components 122 and 126. This motion causes the wheels 78 and 80 to spin in a counterclockwise direction propelling the toy forward.

If the child should push the toy backwards, the interaction of gear rack 134 with gear 116 and gear 116 with gear 106, and finally gear 106 with pinion 86, will freeze the movement of pinion 86. However, when this happens the two slip clutch parts 122 and 126 will slip on each other allowing wheels 78 and 80 to spin without damaging any of the gears or their associated parts. Housing 102 has a rearmost section 150 in which fits tail 38. Tail 38 has a central shaft 152 integrally formed with it around which fits a compression spring 154. Compression spring 154 abuts against the back of housing 102 and biases tail 38 in an outward direction.

A housing cover 156 fits over the top of housing 102 and is maintained thereon by screws (not numbered or shown) which fit into appropriate drillings within both housing cover 156 and housing 102. The drillings are also not numbered in order to simplify the drawing. Cover 156 is best seen in FIG. 8. Projecting from near the center of cover 156 is a shaft 158 having a shoulder 160 near its bottom extremity. A spring member 162 formed out of a material having spring properties fits on the top of the surface of cover 156.

Integrally formed with cover 156 are two brackets collectively identified by the numeral 164. A lever 166 having an axle 168 integrally formed with it is held on to the top of cover 156 by brackets 164. A projection 170 of spring member 162 fits underneath the end 172 of lever 166 which biases the opposite end 174 of lever 166 through a cutout 176 in cover 156. A slot 178 formed in the top of sliding member 132 receives end 174 of lever 166 when sliding member 132 is in its rearmost position, a position wherein compression spring 136 is fully compressed. The sliding member 132 is held in this position by the interaction of end 174 of lever 166 with slot 178.

Figure 7:
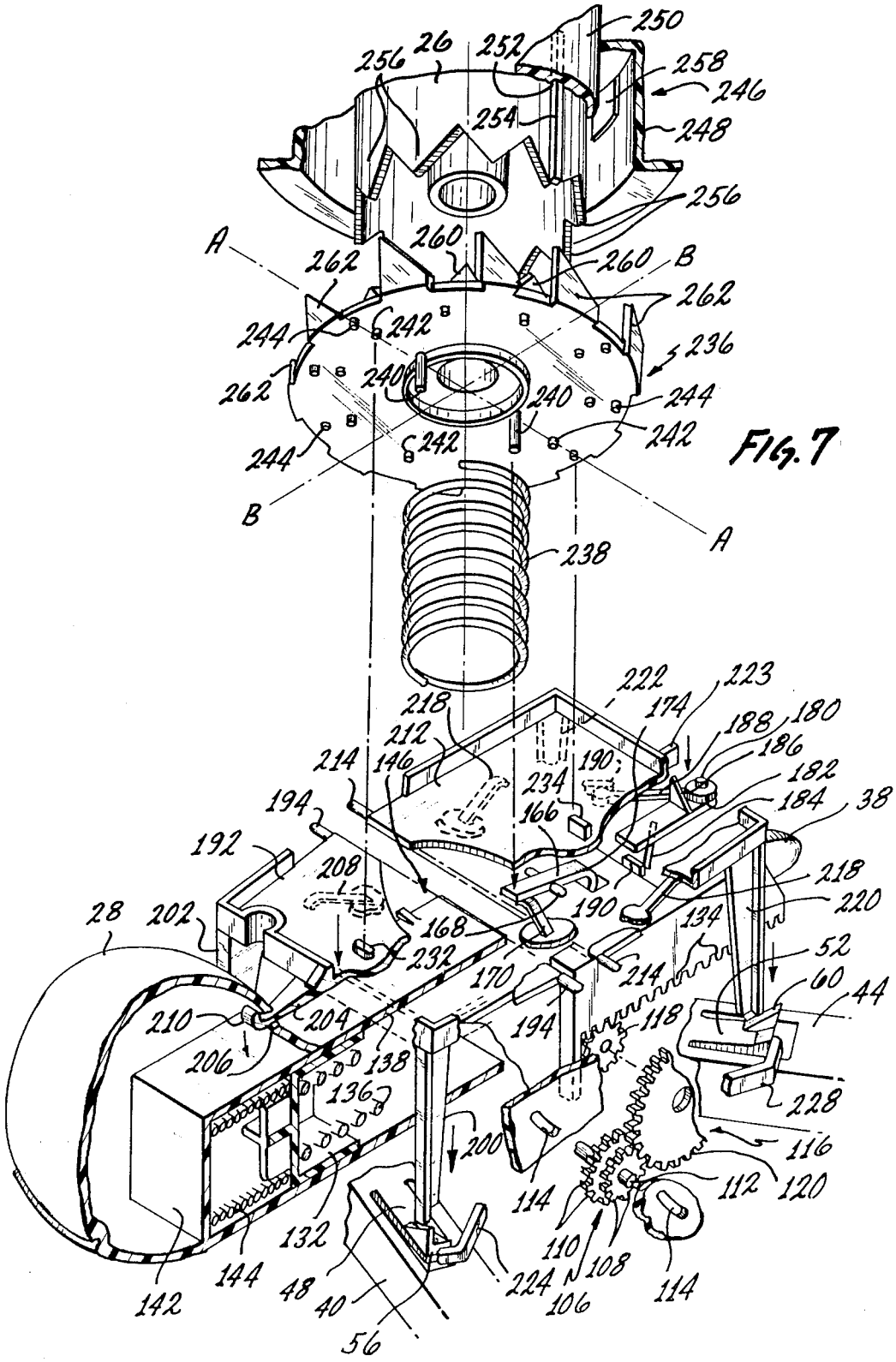
FIG. 7 is an exploded view of certain movable components of the toy.

A small pin 180 integrally formed with the top of compartment cover 156 extends in an upward direction. Fitting on this pin is tail holding member 182. Tail holding member 182 has a small wedge shaped member 184 on its bottom surface. Additionally it has a second wedge shaped member 186 on its top surface. The placement of these two wedge shaped members are best seen in FIGS. 7 and 8. Extending out of the side of tail holding member 182 is a spring member 188 which is appropriately held in two projections 190 integrally formed on the surface of cover 156. Spring member 188 biases tail member 182 toward the position shown in FIGS. 7 and 8.

A small projection 190 on tail 38 is capable of being retained by wedge member 184. When the tail 38 is pushed from an extended position to a retracted position projection 190 pushes against wedge member 184 causing tail member 182 to be displaced against the biasing spring 188. When the projection 190 clears the wedge member 184 tail member 182 returns to its central position as shown in FIGS. 7 and 8 which locks the tail 38 in a retracted position because projection 190 is now held against the backside of wedge member 184.

A front release member 192 has two identical pins collectively identified by the numeral 194 extending from both its sides. These pins fit into two bearing surfaces collectively identified by the numeral 196 in upright projections collectively identified by the numeral 198 which project in a vertical direction and are integrally formed with compartment cover 156. Front release member 192 has two legs, right leg 200 and left leg 202 which project in a downward direction. Additionally, front release member 192 has a retaining finger 204 which projects from its foremost surface toward the front of the toy. When the toy is assembled and the major extension member 138 is slid from its extended position to its retracted position, retaining finger 204 fits within a hole 206 in head 28 attached to major extension member 138. A projection 208 of spring member 162 biases front release member 192 about pins 192 such that a detent tooth 210 on the end of retaining finger 204 locks major extension member 138 in a retracted position.

A rear release member 212 is similar to front release member 192 in that it is suspended by two pins collectively identified by the numeral 214 which rests in two bearing surfaces collectively identified by the numeral 216 formed in upright projections 198. Two projections collectively identified by the numeral 218 of spring member 162 biases rear release member 212 about the pins 214. Two legs 220 and 222 project in a downward direction on the opposite end of rear release member 212. Projecting out of the rear of rear release member 212 is tail release pin 223, which is so placed as to be capable of interacting with wedge shaped member 186.

Integrally formed as part of housing 102 are four holding members, right front holding member 224, left front holding member 226, right rear holding member 228, and left rear holding member 230. These holding members project near the path of travel of the detent teeth 56, 58, 60 and 62 on the bracketed members 40, 42, 44 and 46 of the feet 30, 32, 34 and 36 respectively. When the feet 30, 32, 34 and 36 are pushed against the bias of springs 72 and 74 the respective feet are held in a retracted position by interaction of detent teeth 56, 58, 60 and 62 with the holding members 224, 226, 228 and 230 respectively. The feet 30, 32, 34 and 36 are released from the retracted position to their extended position in pairs, that is, a front pair and a rear pair, whenever either front release member 192 pivots about pins 194 against the bias of spring projection 208 such that leg 200 depresses detent tooth 56 and leg 202 depresses detent tooth 58 freeing these detent teeth from their respective holding members 224 and 226. Likewise, the rear feet 34 and 36 are released when the rear legs 220 and 226 interact with detent teeth 60 and 62. The depression of rear release member 212 also causes tail release pin 223 to fit against wedge shaped member 186 which causes displacement of tail holding member 182 which allows the tail 38 to travel from its retracted position to its extended position.

Projecting from the upper surface of front release member 192 is front release pin 232 and projecting from the upper surface of rear release member 212 is rear release pin 234. When front release member 192 and rear release member 212 are mounted on housing cover 156 front release pin 232 is slightly closer to the center axis of shaft 158 than is rear release pin 234.

A mode disk 236 fits over shaft 158 and its bottommost limit of travel on shaft 158 is governed by mode disk 236 coming to rest against shoulder 160. Interspaced between the top of cover 156 and mode disk 236 about shaft 158 is a compression spring 238. This biases mode disk 236 in an upward direction on shaft 158. As is best seen in FIG. 7 integrally formed on the bottom surface of mode disk 236 are a series of pins. These pins are arranged in what could be envisioned as three concentric circles on the bottom of mode disk 236. The innermost circle of pins, two pins collectively identified by the numeral 240, are capable of interacting with the end 172 of lever 166. The next concentric circle of pins, collectively identified by the numeral 242, are capable of interacting with the front release pin 232 and the outermost concentric circle of pins, collectively identified by the numeral 244, are capable of interacting with the rear release pin 234.

If mode disk 236 is depressed against the bias of compression spring 238 as hereinafter described depending upon the rotational displacement of mode disk 236 about shaft 158, pins 240 may or may not be in position to interact with lever 166, pins 242 may or may not be in position to interact with front release pin 232, and pins 244 may or may not be in position to interact with rear release pin 234. The mode disk 236 is caused to rotate in an arc about shaft 158 each time button 26 is depressed as hereinafter described. This degree of rotation is such that each time the mode disk rotates through this arc a new set of pins (that is, a set of pins falling on a line colinear with a diameter line of mode disk 236, e.g., lines A and B in FIG. 7) are in position to interact with the combination of lever 166 and front and rear release pins 232 and 234. As can be seen in FIG. 7 when a set of pins such as the set lying on line A are in this position interaction will be had with all three of the above noted components 166, 232 and 234. However, when the set of pins such as those falling on the line identified as line B in FIG. 7 are in position, interaction will only be with front release pin 232.

Attached to the top of cover 156 is placement collar 246. Placement collar 246 is fixedly attached to cover 156 by several screws not shown in the drawing. Placement collar 246 includes a large ring section 248 and a small ring section 250 integrally attached to the top of the large ring and extending a short distance within the interior of the large ring 248. Incorporated within the walls of small ring 250 are two guide grooves collectively identified by the numeral 252. Extending vertically along the sides of button 26 are two guide ridges collectively identified by the numeral 254. Button 26 fits within the small ring 250 and the guide ridges 254 on button 26 slide in the guide grooves 252. This allows button 26 to freely go up and down within the small ring 250 but prevents button 26 from any rotational movement within small ring 250. Along the bottom edge of button 26 is a continuous series of teeth collectively identified by the numeral 256. These teeth 256 are triangular in shape and are symmetrical about their central axis.

On the inside of large ring 248 are four mode placement plates collectively identified by the numeral 258. These four plates 258 are located in two groups of two each on opposite sides of the interior of large ring 248. On the top surface of mode disk 236 is a ring of mode teeth 260. The mode teeth 260 are mirror images of the button teeth 256 and are sized and placed on the mode disk 236 such that they are capable of interacting and fitting with the button teeth 256 as is best illustrated in FIG. 12. Along the circumference of the mode disk 236 are a series of mode placement teeth collectively identified by the numeral 262.

The mode disk 236 fits within the large ring 248 as is seen in FIG. 3 in side view and in FIG. 9 in bottom view. The mode placement teeth 262 are so shaped and the mode disk 236 is so dimensioned that when the mode disk 236 is in its uppermost placement within large ring 248 the mode placement plates 258 on the inside surface of large ring 248 fit within the spaces between two adjacent mode placement teeth 262. This locks the mode disk 236 from rotating when the mode disk 236 is located within the upper portion of large ring 248. When in this upper placement the mode teeth 260 fit within the small ring 250 and are theoretically capable of perfectly meshing with the button teeth 256; however, in this placement the mode teeth 260 are radially displaced a few degrees from a perfect alignment with button teeth 256. Because button 26 is locked with respect to its radial displacement by the interaction of guide ridges 254 in guide grooves 252 and the mode disk 236 is similarly locked as to its radial displacement by the mode placement teeth 260 with the mode placement projections 258 neither can radially shift its position which results in the interaction of the button teeth 256 with the mode teeth 260 as is shown in FIG. 3.

When the button 26 is depressed the downward motion similarly depresses the mode disk 236 against the bias of compression spring 238. When the button 26 is depressed it and the mode disk 236 start their descent locked in their initial position with respect to their button teeth 256 and the mode teeth 260. The button 26 throughout its whole limit of travel is maintained fixed radially wihin the small ring 250 by the guide groove 252 and guide ridges 254. The mode disk 236, however, is maintained in a fixed radial position for only a portion of its descent. As soon as the mode placement teeth 262 clear the bottom of the mode placement plates 258 the mode disk 236 is free to rotate. Because the button teeth 256 and the mode teeth 260 are not in perfect alignment and because of the shape of the button teeth 256 and mode teeth 260 as soon as the mode disk 236 is free of the mode placement plates 258, the mode disk 236 will rotate a few degrees until the button teeth 256 and the mode teeth 260 become aligned as shown in FIG. 12. At this time the mode placement teeth 262 have assumed an alignment with the mode placement plates 258 as is shown in FIG. 10 as viewed from the bottom and FIG. 11 as viewed from the side.

When the button 26 is released compression spring 238 forces the mode disk 236 in an upward direction. However, before the mode disk 236 can travel upward within large ring 248 it must further turn in order that the mode placement teeth 262 be aligned within the spaces between the mode placement plates 258. Because both the mode placement teeth 262 and the mode placement plates 258 have inclined surfaces which mate, these inclined surfaces slip on one another causing the mode disk 236 to rotate until the mode placement teeth 262 can once again slide within the spaces between the mode placement plates 258. If the button 26 is once again depressed the cycle is repeated causing the mode disk 236 to again rotate through an arc which is equal to the radial distance between the centers of any two mode placement teeth 262.

The pins 240, 242 and 244 are so placed on the bottom of mode disk 236 that when button 26 is depressed and mode disk 236 is in its most downward displacement, the interaction of mode teeth 260 with button teeth 256 correctly places the mode disk 236 such that pins 240, 242 and 244 are positioned over the respective parts which they interact with—that is, front release pin 232, rear release pin 234 and lever 166, respectively.

I claim:

1. A toy which comprises:

a base, a plurality of movable extensions independently movably mounted on said base such that each of said extensions is movable on said base between a retracted position and an extended position, a plurality of holding means operatively associated with said plurality of said movable extensions, each of said holding means operatively connected to one of said extensions and reversibly holding said extension in said retracted position on said base, releasing means mounted on said base and having a plurality of operational modes wherein in each of said operational modes one or more of said holding means is activated allowing said movable extension associated with said activated holding means to move from said retracted position to said extended position.

2. The toy of claim 1 wherein:

said base includes locomotion means mounted on said base for propelling said toy along a surface.

3. The toy of claim 2 wherein:

said locomotion means are operatively connected to said releasing means whereby said locomotion means propels said toy along said surface in some of said operational modes and said locomotion means does not propel said toy along said surface in the remainder of said operational modes.

4. The toy of claim 3 wherein:

said locomotion means includes movable support means movably supporting said toy above said surface, and energizing means operatively connected to said movable support means for propelling said toy on said surface.

5. The toy of claim 4 wherein:

one of said plurality of movable extensions is a primary extension and the remainder of said plurality of extensions are secondary extensions, said energizing means is operatively connected to said primary movable extension such that when said primary movable extension is moved from said extended position to said retracted position said energizing means is energized and when said primary movable extension moves from said retracted position to said extended position said energizing means is de-energized and said energy is transferred to said movable support means propelling said toy across said surface.

6. The toy of claim 5 wherein:

said releasing means includes a mode member movably mounted on said base, said mode member having a plurality of release members mounted thereon, said mode member having a plurality of positions, each one of said positions corresponding to one of said operational modes, at least one of said release members independently capable of interacting in each of said positions with at least one of said holding means activating said interacted holding means.

7. The toy of claim 6 wherein:

said mode member comprises a disk both rotatably and slidably mounted on said base, said plurality of release members comprise a plurality of projection members, said projection members being spaced on said disk such that when said disk rotates on said base each of said projection members are independently capable of assuming a plurality of placements, some of said placements placing said projection member in a position wherein said projection members interact with one or more of said holding means and the remainder of said placements placing said projection member in a position wherein said projection member does not interact with any of said holding means.

8. The toy of claim 7 wherein:

said energizing means includes a bias means biasing said primary movable extension toward said extended position, said movable support means includes at least two wheels mounted on said base and supporting said toy above said surface, said primary movable extension including motion transfer means operatively connected to at least one of said wheels such that when said movable extension moves from said retracted position to said extended position under the influence of said biasing means, said motion transfer means transfers said movement of said primary movable extension to said one of said wheels.

9. The toy of claim 8 wherein:

said motion transfer means includes a rack of gears fixedly attached on a portion of said primary movable extension and at least one gear operatively connected to said one of said wheels and capable of interacting with said rack of gears when said primary movable extension moves from said retracted position to said extended position.

10. The toy of claim 9 wherein:

said toy comprises a simulated animal and said base comprises at least a portion of the body of said animal, said animal including a head, said head of said animal attached to said primary movable extension, said animal including a plurality of flexible limbs, said secondary movable extensions including at least some of the flexible limbs of said animal such that said head and said flexible limbs are capable of moving from an extended position outside of said body of said animal to a retracted position wherein at least a portion of said head and said limbs are retracted into said body.

11. A toy which comprises a base, said base including a plurality of wheels rotatably mounted to said base, said wheels capable of supporting said toy on a surface, one major movable extension movably mounted on said base between an extended position wherein said major extension extends away from said base and a retracted position wherein at least a part of said major extension retracts into said base, a plurality of minor extensions, each independently movable between an extended position wherein each of said minor extensions extends away from said base and a retracted position wherein at least a part of said minor extension retracts into said base, a plurality of holding members equal in number to the total of said major extension and said minor extensions, one of said holding members associated with said major extension, one of said holding members associated with each of said minor extensions, said holding members each independently capable of holding the movable extension it is associated with in said retracted position, biasing means for biasing said major extension toward said extended position, motion transfer means mounted on said major extension and operatively connected to at least one of said wheels, said motion transfer means transferring the motion of said major extension when said major extension moves from said retracted position to said extended position to said wheel such that said wheel propels said toy on said supporting surface, a shaft mounted on said base, a mode disk rotatably mounted on said shaft, said mode disk including a plurality of holding member activating projections spaced around said disk, said activating projections spaced on said mode disk such that when said mode disk rotates on said shaft each of said activating projections are independently capable of assuming a plurality of placements, some of said placements placing said activating projections in a position wherein said activating projection interacts with one of said holding means and the remainder of said placements placing said activating projection in a position wherein said activating projections do not interact with any of said holding means.

12. The toy of claim 11 including:

mode disk rotation means for rotating said mode disk on said shaft, mode disk rotation placement means for governing the degree of rotation of said mode disk on said shaft.

* * * * *